United States Patent [19]

Henrichs

[11] 4,158,463

[45] Jun. 19, 1979

[54] ADJUSTABLE KEEPER FOR ROTARY LATCHES

[75] Inventor: Bernard W. Henrichs, Villa Park, Calif.

[73] Assignee: Hartwell Corporation, Placentia, Calif.

[21] Appl. No.: 828,159

[22] Filed: Aug. 26, 1977

[51] Int. Cl.[2] ..... E05C 13/00

[52] U.S. Cl. ..... 292/341.18

[58] Field of Search ..... 292/241, 190, 170, 341.18, 292/341.19

[56] References Cited

U.S. PATENT DOCUMENTS

| | | | |
|---|---|---|---|
| 2,710,217 | 6/1955 | Curtiss, Jr. et al. | 292/341.18 |
| 2,767,007 | 10/1956 | Burke | 292/341.18 X |
| 3,503,642 | 3/1970 | Poe | 292/240 |

*Primary Examiner*—Richard E. Moore

*Attorney, Agent, or Firm*—Lyon & Lyon

[57] ABSTRACT

An adjustable keeper for rotary latches utilized to secure panels or doors in flush relation to the surrounding surface of an aircraft, the latch being rotatable about an axis perpendicular to the surface of the panel or door, and including an externally accessible flush handle; the keeper including a keeper member movable radially with respect to the latch; an adjustable screw, the head of which is disposed in registry with a small opening through which may be inserted a turning tool such as an Allen wrench, and a connecting mechanism for converting rotation of the screw to radial adjustment of the keeper member.

2 Claims, 5 Drawing Figures

ADJUSTABLE KEEPER FOR ROTARY LATCHES

BACKGROUND AND SUMMARY

Rotary latches have been widely used for flush doors and panels forming a part of the external surface of an aircraft. Heretofore, adjustment of the keeper for the rotary latches has required that the door or panel must be open.

The present invention is directed to a keeper for otherwise conventional aircraft rotary latches such as shown in, but not limited to, U.S. Pat. No. 3,503,642, and is summarized in the following objects:

First, to provide an adjustable keeper for rotary latches which is accessible through an opening of minimal area when the door or panel is closed to eliminate any slack or free movement, and to apply a predetermined force securing the door or panel in its closed position.

Second, to provide an adjustable keeper which is particularly adapted for doors or panels requiring several rotary latches as each keeper may be separately adjusted without the need to repeatedly open and close the door or panel.

DETAILED DESCRIPTION

Figure 3:
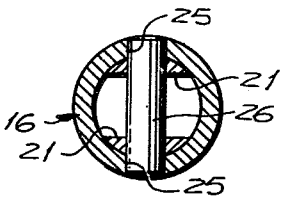
FIGS. 3, 4 and 5 are transverse sectional views of the adjustable keeper taken through 3—3, 4—4 and 5—5 of FIG. 2, respectively.
Figure 4:
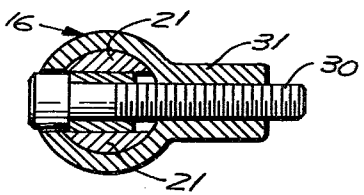

The adjustable keeper for rotatable latches is intended for use in conjunction with a panel 1 carried by an outer frame structure 2 and an inner frame structure 3. If the structures are circular, they may be joined by a screw-threaded connection 4 concentric with the axis of the panel 1. In many cases, however, the panel may not be circular in which other conventional means are used to join the frame structures, or a single frame structure may be utilized. In any case, there is formed a circumferential displaced margin 5 which receives the peripheral margin 6 of the panel 1 so as to place the margin 6 flush with a surrounding surface 7.

The adjustable keeper for rotary latches is intended primarily for aircraft having an access opening closed by a door secured by appropriate hinges, not shown, to the surrounding structure of the aircraft. Also, the access opening may be closed by a removable panel secured in place by a plurality of keepers and rotatable latches. The term "panel" as herein used may be a hinged structure, and thus a door panel, or may be a removable panel.

Figure 2:
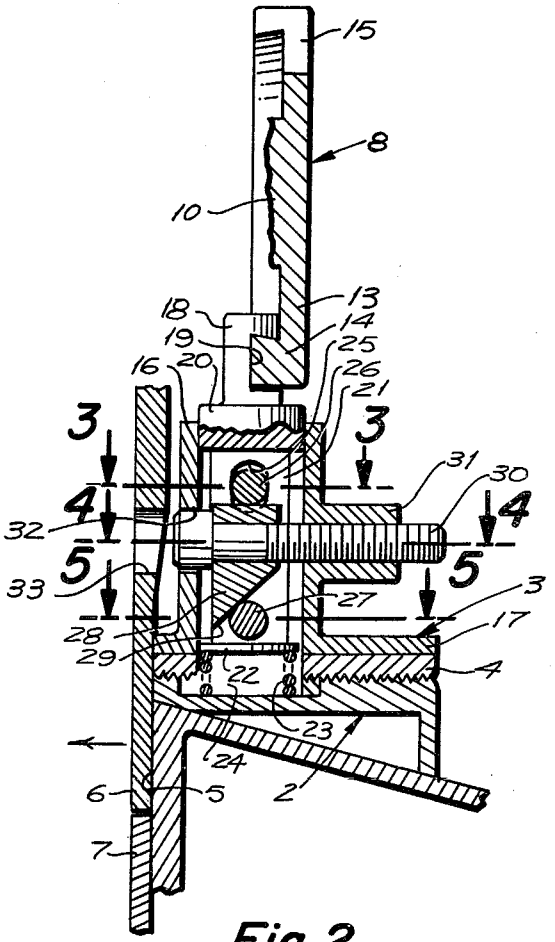
FIG. 2 is a fragmentary sectional view thereof taken through 2—2 of FIG. 1 showing only the rotary latch element of the rotary latch structure.
Figure 1:
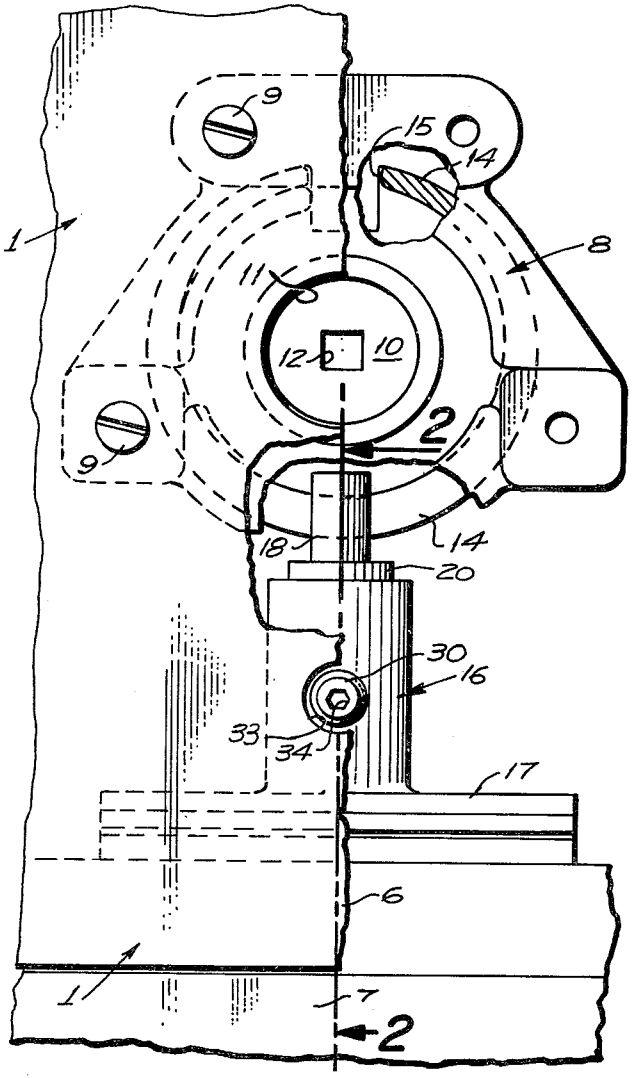
FIG. 1 is a side view of the adjustable keeper and a rotary latch and adjacent portions of a panel broken away to expose portions of the adjustable keeper and rotary latch.

The adjustable keeper cooperates with a conventional rotary latch 8 which is secured to the inner side of the panel by screws 9 and which includes a rotary boss 10 having an outer end fitted within an access opening 11 provided in the panel. The boss 10 is provided with a tool socket 12. The inner end of the boss 10 is provided with a latch disc 13, which in FIG. 2 is shown broken away from the remainder of the rotary latch. The latch disc 13 includes an outwardly directed circular latching flange 14 having a keeper releasing notch 15.

The structure thus far described may be considered as conventional, and other types of rotary latches may be used if provided with an arcuate latch arranged to be rotated about the axis of the latch.

The adjustable keeper includes a cylindrical housing 16 disposed in radial relation to the rotary latch. The housing is provided with a base flange 17 arranged for attachment at an appropriate location on the inner frame structure 3. A keeper stem 18 is provided having a side slot 19 for engaging the latching flange 14. The radially outer end of the keeper stem 18 is enlarged and forms a supporting cylinder 20 slidable in the housing 16. The radially outer portion of the supporting cylinder 20 is provided with a longitudinal slot so as to form parallel arms 21. The radially outer extremities of the arms 21 engage a disc 22 backed by a spring 23 mounted in a recess 24 formed in the frame structures 2 and 3.

Figure 5:
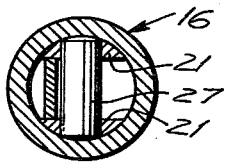

Adjacent to the radially inner ends of the arms 21 is provided an opposed pair of slots 25 which receive a cross pin 26, the ends of which are fixed in the housing 16 as indicated in FIG. 3. Near their radially outer extremities, the arms 21 receive a second cross pin 27 as shown in FIG. 5. Disposed between the cross pins is a slide block 28, one end of which bears against the cross pin 26 and the other end which is beveled as indicated by 29 bears against the cross pin 27. The slide block 28 is provided with a cross bore which receives an adjustment screw 30 extending essentially perpendicular to the surface of the panel 1. The axially inner end of the screw 30 is received in a screw-threaded boss 31. The axially outer end of the screw is received in a perforation 32 provided in the housing and registers with a perforation 33 provided in the panel 1. This end of the screw is provided with an Allen wrench socket 34.

Operation of the adjustable keeper is as follows:

An initial adjustment of the keeper stem 18 is made so that, when the panel is closed, the keeper stem 18 is in free engagement with the latching flange 14. When the panel is closed, a final adjustment is made by turning the adjustment screw 30 forcing the slide block 28 is a radially outer direction causing the beveled end 29 to draw the cylinder 20 radially outward bringing the radially inner end of the side slot 19 into predetermined frictional bearing contact with the radially inner side of the latching flange 14. The confronting portions of the side slot 19 and the radially inner side of the latching flange 14 are tapered so as to resist any outward force which may be exerted against the panel 1.

Having fully described my invention, it is to be understood that I am not to be limited to the details herein set forth, but that my invention is of the full scope of the appended claims.

I claim:

1. An adjustable keeper cooperating with a rotary latch, having an arcuate latch element rotably mounted on a panel fitting an opening bordered by a mounting frame which opening receives the periphery of the panel in flush relation to a surface surrounding the mounting frame, said keeper comprising:

a housing for mounting on a mounting frame adjacent a rotary latch element;

a movable keeper disposed in the housing and having a portion for engagement by the rotary latch element;

means for effecting adjustment of the keeper including a screw element extending transverse to the direction of movement of said keeper in said housing and accessible from the exterior of the housing;

said keeper including a radially movable cylinder means in said housing, a drive block having a beveled cam end for engaging said cylinder means;

the screw element engaging the drive block to cause its beveled end to move transversely in the direction of said screw element to effect movement of the keeper.

2. The combination with a panel associated with an opening formed in an outer wall of an aircraft, said panel having at least one rotatable latch thereon in proximity to a margin of the opening when said panel is therein, said latch including a latch element movable about an axis on said panel, said latch being accessible externally of the panel and a keeper access opening formed in the panel, of an adjustable keeper, comprising:

a. a housing fixed to the margin of the opening and having a bore in radial relation to the axis of the latch element;

b. a keeper having a portion radially movable in the bore of the housing and a keeper end engageable with the latch element;

c. a screw member mounted on said margin disposed generally parallel to the axis of the latch element and including an outer end exposed to said access opening;

d. and means interposed between the keeper and screw member to effect radial movement of the keeper upon rotation of the screw member.

* * * * *